United States Patent [19]

Fareri et al.

[11] 4,386,937

[45] Jun. 7, 1983

[54] WAX-IMPREGNATED FIRE KINDLING STICKS

[75] Inventors: Elizabeth L. Fareri, Pittsburgh; Philip R. Templin, Oakmont Borough, both of Pa.

[73] Assignee: Gulf Research & Development Company, Pittsburgh, Pa.

[21] Appl. No.: 319,013

[22] Filed: Nov. 9, 1981

[51] Int. Cl.[3] ..... C10L 11/02; C10L 11/06

[52] U.S. Cl. ..... 44/41; 44/38

[58] Field of Search ..... 44/38, 41

[56] References Cited

U.S. PATENT DOCUMENTS

| | | | |
|---|---|---|---|
| 3,338,691 | 8/1967 | Knowles et al. | 44/41 X |
| 3,346,352 | 10/1967 | McCoy et al. | 44/41 X |
| 3,540,865 | 11/1970 | Pape | 44/38 |
| 4,189,305 | 2/1980 | Clayton | 44/41 |

*Primary Examiner*—Carl F. Dees

*Attorney, Agent, or Firm*—Deane E. Keith; Forrest D. Stine; Donald L. Rose

[57] ABSTRACT

Porous cellulosic fiberboard containing a significant amount of an expanded vitreous particulate material such as expanded perlite and impregnated with a hydrocarbon wax has improved burn time when used in the ignition of wood and coal fires.

11 Claims, No Drawings

WAX-IMPREGNATED FIRE KINDLING STICKS

SUMMARY OF THE INVENTION

Cellulosic fiberboard compositions can be produced in stick-like shapes and impregnated with a hydrocarbon wax. These combustible sticks can be utilized for starting charcoal, wood and coal fires, such as in grills, in fireplaces and in furnaces. One of the primary considerations affecting the efficacy of these fire igniting sticks is the total burn time of the wax-impregnated stick. We have discovered that when the fiberboard is produced with a significant content of an expanded vitreous material, such as perlite, vermiculite and the like, the burn time and the resulting fuel-ignition effectiveness of the stick can be substantially increased, even though a lower overall quantity of wax is used.

DESCRIPTION OF THE INVENTION

The commercial production of cellulosic fiberboard in sheet form for use in residential and commercial construction as thermal and sound insulating barrier material is well established. When this fiberboard material is cut into suitably sized strips, the resulting sticks can be impregnated with a combustible hydrocarbon wax and used as kindling for starting log and coal fires.

We have made the surprising discovery that the total burn time of the wax-impregnated fire kindling stick can be substantially increased, even though a lower quantity of wax is used if an expanded vitreous material such as perlite, vermiculite and the like is incorporated into the fiberboard structure during its manufacture. The use of a hydrocarbon wax in the fire-starting stick ensures that the combustion is uniform and hot. However, a critical factor governing the effectiveness of the sticks as fire starters, particularly with coal and larger sized logs, is the duration time of the combustion. It is generally desired that the burn time last at least about fifteen minutes and more desirably at least about twenty minutes to ensure ignition.

The fiberboard can be prepared in a conventional wet process by producing an aqueous slurry of a suitable cellulosic material, an expanded vitreous material and a suitable binder and laying down and dewatering the mixture in Fourdrinier-type equipment. Alternatively the fiberboard can be prepared using a dry mix and calendering the mixture at a suitable pressure and temperature to obtain the desired density and porosity. The cellulosic component can be a single material or a mixture of suitable cellulosic materials obtained from wood, reclaimed paper, cotton, hemp, jute, bagasse, straw, leaves, shells, and the like. The cellulosic material will frequently contain a mixture of waste or scrap materials from a variety of sources and can include cellulosic fibers and cellulosic powders. The amount of cellulosic material in the dried, unwaxed product will generally be within the range of about 60 to about 95 percent, and more generally within the range of about 70 to about 90 percent of the finished board.

The fiberboard used in our invention also contains an expanded vitreous material. Expanded perlite, expanded vermiculite and similar expanded inorganic vitreous material can be used. Perlite is a well-known, naturally occuring volcanic glass consisting essentially of aluminum silicate and about one to five percent bound water. When heated rapidly to a suitable elevated temperature, the bound water is vaporized, causing an expansion of about ten to twenty times the original volume. Vermiculite is a hydrated micaceous mineral which expands about six to twenty times its original volume on heating. In general, the particle size of the expanded vitreous material can suitably be within a range of about 0.1 to about 10 mm, more generally between about 0.2 to about 2 mm in diameter, although some material outside this broad range can also be present. The expanded vitreous material will constitute between about one and about 20 weight percent of the finished board, more suitably between about five and about 15 percent of the board.

The third essential component of the fiberboard is an adhesive or binder. The binder not only holds the fibrous-vitreous mixture together, once formed, but also helps maintain the integrity of the shape even during its combustion. The binder can be a suitable aqueous or non-aqueous adhesive depending on the process used. Suitable binder material includes water glass, vegetable starch, guar gum, a dry natural or synthetic resin, and the like. The finished board will contain between about one and about ten weight percent binder, more generally between about 2.5 and about 7.5 percent binder.

The above describes the preparation of relatively large sheets of fiberboard material. These sheets can vary in thickness from about 5 mm to about 30 mm and more, with a thickness within the range of about 10 mm to about 25 mm being especially suitable for the fire starter stick of our invention. Once formed the board can be slit into strips of a suitable width, such as from about 5 mm to about 50 mm wide, more generally from about 10 mm to about 35 mm wide. These strips can then be cut into a suitable length. A length between about 2.5 cm and about 75 cm can be suitably used, but a length between about 5 cm and about 50 cm is overall more convenient. The expression "stick" as used herein is intended to include rectangular shapes, or cubes, in which all dimensions are similar. These cubic sticks are particularly suitable in starting charcoal briquettes.

The stick-shaped substrate is next impregnated with a suitable wax, preferably a hydrocarbon wax. The sticks can suitably be submerged in a vessel of hot molten wax until the wax permeates the entire porous network of the cellulosic substrate to substantially completely fill the interconnected void space within the substrate. Since the wax will essentially fill the void volume within the fiberboard material, this void volume approximates the volume of wax incorporated into the fiberboard. In general, the fiberboard will broadly contain between about 30 and about 80 weight percent wax, more generally between about 50 and about 70 weight percent wax.

Although animal or vegetable waxes or synthetic hydrocarbon waxes can be used in the fire kindling sticks of our invention, these natural and synthetic waxes are generally too expensive for practical application in our invention. Therefore, we recommend a suitable normally solid hydrocarbon wax, and, in particular, a suitable petroleum wax resulting from the refining of petroleum, such as a refined wax, a slack wax, a tank bottoms wax, a motor oil refinery wax, and the like. The wax can be a paraffin wax, a microcrystalline wax, an intermediate wax or a mixture of these waxes. Refined waxes can be graded by their congealing point, as determined by ASTM D938. According to this classification the waxes will have a congealing point between about 100° F. and about 200° F., preferably between about 130° F. and about 170° F.

DESCRIPTION OF PREFERRED EMBODIMENTS

EXAMPLES 1-5

In the following experiments, fiberboard A is a commercial product weighing about 17.5 pounds per cubic foot, prepared from wood fiber and starch binder and having about ten weight percent expanded perlite incorporated within the fiberboard. Fiberboard G is also a commercial product weighing about 17.3 pounds per cubic foot and prepared from wood fiber and a vegetable drying oil binder. The data in the following table was obtained by averaging the results obtained by burning two or more separate specimens in each experiment. Each specimen was lighted at one end, with the total burn time being determined at the extinction of the last flame. The ash was weighed, and that obtained from fiberboard A, principally comprising perlite, varied between 10.5 and 13.6 weight percent of the initial unwaxed stick, while the ash obtained from fiberboard G varied between 1.6 and 2.5 weight percent of the initial unwaxed fiberboard. The sticks were 11.5 to 12.0 inches in length, were one and one-quarter inches wide and about one-half inch thick. The results are set out in the following table:

TABLE

| Ex. | Stick | Wax[a] | Unwaxed, Grams | Waxed, Grams | % Wax | Burn time, min. |
|---|---|---|---|---|---|---|
| 1 | A | 160° F. | 29.3 | 64.2 | 54.4 | 23.3 |
| | G | 160° F. | 25.1 | 65.0 | 61.4 | 20.0 |
| 2 | A | 131° F. | 29.8 | 69.6 | 57.0 | 12.9 |
| | G | 131° F. | 24.3 | 71.0 | 65.8 | 9.6 |
| 3 | A | 157° F. | 42.2 | 89.0 | 52.6 | 21.2 |
| | G | 157° F. | 30.2 | 72.8 | 58.5 | 18.6 |
| 4 | A | 130° F. | 42.2 | 95.4 | 55.8 | 12.5 |
| | G | 130° F. | 30.4 | 77.9 | 61.0 | 10.6 |
| 5 | A | —[b] | —[c] | 85.8 | —[c] | 14.7 |
| | G | —[b] | 28.5 | 74.2 | 61.6 | 10.5 |

[a]congealing point by ASTM D938
[b]wax mixture congealing between 130° and 150° F.
[c]not determined It is noted that the burn time of stick A was longer than the burn time of stick G in each example.

It is to be understood that the above disclosure is by way of specific example and that numerous modifications and variations are available to those of ordinary skill in the art without departing from the true spirit and scope of the invention.

We claim:

1. A wax-impregnated fire kindling stick comprising a bonded cellulosic substrate comprising between about one and about 20 weight percent of an expanded vitreous material, said substrate being impregnated with a normally solid hydrocarbon wax.

2. A wax-impregnated fire kindling stick in accordance with claim 1 in which the cellulosic substrate comprises between about five and about 15 weight percent of an expanded vitreous material.

3. A wax-impregnated fire kindling stick in accordance with claim 2 in which the expanded vitreous material is perlite.

4. A wax-impregnated fire kindling stick in accordance with claim 1 wherein said wax-impregnated stick contains between about 30 and about 80 weight percent wax.

5. A wax-impregnated fire kindling stick in accordance with claim 1 wherein said wax has a congealing point between about 100° and about 200° F.

6. A wax-impregnated fire kindling stick in accordance with claim 3 wherein said wax-impregnated fire kindling stick contains between about 50 and about 70 weight percent wax.

7. A wax-impregnated fire kindling stick in accordance with claim 3 wherein said wax has a congealing point between about 130° and about 170° F.

8. A wax-impregnated fire kindling stick in accordance with claim 1 comprising between about one and about 20 weight percent of a binder.

9. A wax-impregnated fire kindling stick in accordance with claim 3 comprising between about 2.5 and about 7.5 percent of a binder.

10. A wax-impregnated fire kindling stick in accordance with claim 1 in which the thickness of said stick is between about 5 mm and about 30 mm, the width is between about 5 mm and about 50 mm, and the length is between about 2.5 cm and about 75 cm.

11. A wax-impregnated fire kindling stick in accordance with claim 3 in which the thickness of said stick is between about 10 mm and about 25 mm, the width is between about 10 mm and about 35 mm, and the length is between about 5 cm and about 50 cm.

* * * * *